US007753827B1

(12) United States Patent
Emick

(10) Patent No.: US 7,753,827 B1
(45) Date of Patent: Jul. 13, 2010

(54) WRIST ROLLER EXERCISE DEVICE

(76) Inventor: Daniel W. Emick, 4882 State Route 87 Hwy., Williamsport, PA (US) 17701

( * ) Notice: Subject to any disclaimer, the term of this patent is extended or adjusted under 35 U.S.C. 154(b) by 0 days.

(21) Appl. No.: 12/459,364

(22) Filed: Jun. 29, 2009

(51) Int. Cl.
*A63B 23/16* (2006.01)

(52) U.S. Cl. ..... 482/44; 482/45

(58) Field of Classification Search ..... 482/91, 482/126, 904, 44, 49, 45
See application file for complete search history.

(56) References Cited

U.S. PATENT DOCUMENTS

| | | | | | |
|---|---|---|---|---|---|
| 332,989 | A | | 12/1885 | Benedict | |
| 2,475,656 | A | | 7/1949 | Bidak | |
| 3,740,033 | A | | 6/1973 | Kamp | |
| 3,982,755 | A | | 9/1976 | Sarich | |
| 4,072,308 | A | * | 2/1978 | Applegate | 482/94 |
| D264,237 | S | | 5/1982 | McCaleb et al. | |
| 4,438,920 | A | | 3/1984 | Veillette | |
| 4,974,836 | A | * | 12/1990 | Hirsch | 482/40 |
| 5,312,309 | A | * | 5/1994 | Fox | 482/45 |
| 5,967,949 | A | | 10/1999 | Davenport | |
| 6,019,704 | A | * | 2/2000 | Morgan | 482/46 |
| 6,099,437 | A | | 8/2000 | DeMers | |
| 6,234,934 | B1 | | 5/2001 | Gorczyca | |
| 6,312,359 | B1 | | 11/2001 | Brundle | |
| D505,459 | S | | 5/2005 | Lagattuta | |
| 7,029,423 | B2 | | 4/2006 | Lear, Jr. | |

* cited by examiner

*Primary Examiner*—Jerome Donnelly
(74) *Attorney, Agent, or Firm*—Thomas R. Shaffer

(57) ABSTRACT

A wrist roller exercise device is provided which has a roller rod having opposite handle end portions and which has a central portion and has a spool carrier has a central balanced cable connection point. A cable is connected to the cable connection point and also connected to an elevated frame member to secure and hold the carrier at a desired elevation above ground surface. A spool is attached on the central portion of said rod member with the rod member and the spool each being rotatable relative to the spool carrier. The spool also has a rope connection thereon. A rope is provided which has a first rope end attached to the rope connection and a second rope end connected to a weight object of desired mass. The cable supports the weight of the device so that a user can focus attention on forearm, wrist, hand and finger muscles required to wind up the rope and to keep the device balanced on the cable and not on upper arm, shoulder, chest and back muscles which would otherwise be required to hold and suspend the device in the desired elevation above ground surface if not for the cable.

11 Claims, 9 Drawing Sheets

WRIST ROLLER EXERCISE DEVICE

BACKGROUND OF THE INVENTION

1. Field of the Invention

The present invention relates to a wrist roller exercise device. More specifically, it relates to a wrist roller exercise device having a cable suspended spool cradle to support the weight of the device to relieve the arms, shoulders and back of the user.

2. Description of the Prior Art

A wrist roller exercise is a common exercise for strengthening the grip and forearms of an exerciser who stands vertically with arms fully extended forward from the body and fixed and held at shoulder level. With hands gripping either side of a wrist roller exercise device (a shaft or rod with a center portion or spool for a strap or rope attachment, and gripping handles on each end) the exerciser alternatively twists the handles at opposite ends of the rod which in turn serves to coil up the rope or strap attached to the wrist roller exercise device. The effect is to cause the weighted device (weight plate, etc.) attached to the opposite end of the strap or rope to rise systematically from the starting point at floor level to the conclusion at the uppermost range of the exercise movement. The exerciser then reverses the twisting of the handles motion until the weighted device once again reaches the floor level and repeats the process for a desired number of repetitions. The simplest form of a wrist roller exercise device comes in the form of a simple straight shaft to which a rope or strap attaches to the center portion thereof with gripping surfaces on either end of the shaft or rod. Attached to an opposing end of the rope or strap is a simple weight plate holder as a means of adding necessary resistance to the wrist roller exercise device. The primary drawback to this traditional form of a wrist roller exercise device is that the exerciser commonly experiences trapezoid and shoulder muscle fatigue long before exhausting the targeted muscles of the forearms, wrists and hands. This occurs because the users of the traditional wrist roller exercise device must maintain an out stretched arm position under load for extended periods of time in order to achieve the desired exercise repetitions. The end result of this inability to direct focus energy into desired muscle groups is a less than optimal training effect. A lesser drawback to the traditional wrist roller exercise device is the inability to affix alternate weighted implements such as dumbbells to the wrist roller exercise device rope or strap.

A number of prior art patents describe wrist rolling exercise devices which are fully supported by the arms, shoulders and back of the user. In these devices there is no frame member whatsoever to support any of the weight of the device. Sarich, U.S. Pat. No. 3,982,755, discloses the provision of a rod 15 which is used in connection with a wound cord 13. This particular patent utilizes a transparent bottle 11 which has level indicators on it so that when it is filled with water the amount of weight can be precisely changed.

Gorczyca, U.S. Pat. No. 6,234,934, discloses a wrist and forearm exerciser which includes an elongated handle rod 12, a line 13 and a plurality of weights 17. The handle rod has a pair of grasping sleeves 19.

Brundle, U.S. Pat. No. 6,312,359, discloses a grip exercise apparatus which includes first and second end portions 12 and 14 and a center portion 16. A weight support cable 38 is used to connect a flexible bag 40. Any number of and different type of weight elements 44 may be inserted into the flexible bag 40 to provide any desired total weight.

Lagattuta, U.S. Design Pat. D505,459, discloses a similar forearm exercise device. McCaleb et al., U.S. Design Pat. Des. 264,237, likewise discloses a similar handheld exercise device.

DeMers, U.S. Pat. No. 6,099,437, discloses a similar exercise apparatus but which utilizes a lanyard or strap 12 connected at one end to a weight 11 adapted to be wound and unwound around an elongate body 13.

Bidak, U.S. Pat. No. 2,475,656, discloses yet another handheld exercise device which includes a shaft 10 which holds a drum 11 consisting of discs 15 and 16 connected together by pins or rungs 25. This forms an annular arrangement around which the cord 12 is wound.

Other references disclose the provision of a wrist roller exercise device which is supported on opposite ends by some type of supporting frame. One such reference is the Power Wrist Roller—#C-0140 from the New York Barbell of Elmira Corp.

A somewhat similar device is disclosed in Davenport, U.S. Pat. No. 5,967,949, which discloses the provision of an axel unit 12 rotatably received and carried by an adjustable stand 14. Detachable handle units 18 are shown. The weights 54*a* and 54*b* may be received by the cord 52 and rest upon the platform 56. The handles are telescopic so that you can selectively vary the leverage while rolling up the device.

Lear, Jr., U.S. Pat. No. 7,029,423, discloses yet another cord-winding exercise apparatus which includes a winding bar 12 which is mounted on a door frame 50 by brackets 18 and 22 at opposite ends thereof. The brackets 18 and 22 are preferably formed of nylon, plastic, silicone or other low friction material. FIGS. 1-3 show two cords 24-34 attached to the winding bar 12 through openings 15. FIG. 4, shows an arrangement with a single cord 78.

Benedict, U.S. Pat. No. 332,989, shows a very early patent from 1885 which discloses the provision of a wrist rolling device which includes a cord and pulley mechanism on a horizontal bar. For the purpose of utilizing the horizontal bar as a wrist roller, the cords of the pulley weights are detached from the pulleys I and passed through and attached to removable or fixed eyebolts P in the horizontal bar, and the pin C removed, so that the bar may freely turn in its sockets. This device provides a horizontal bar in a cabinet exercising apparatus.

A couple of patents appear to discuss the concept of gripping the bar and the amount of friction needed to accomplish such gripping. Kamp, U.S. Pat. No. 3,740,033 discloses an isotonic exercising device which includes a base strip 12, a straight rod 20 and a pair of elongated flat straps 22 and 24. Kamp teaches that an important element of the apparatus is the material for gripping the rod such as a pair of gloves 40. The gloves 40 are preferably made of leather or other material which will have sufficient friction relative to the metal rod to make it possible to retard rotation of the rod by gripping and yet allow the rod to slip in the gloves. Kamp also teaches "an alternative to gloves is a sleeve of leather or the like which fits on the rod with a slip fit". A sleeve may be provided on each end of the rod. In use, the straps 22 and 24 have been rolled on the rod so that at the beginning of the exercise the rod is just below waist level. The user raises the rod until the straps 22 and 24 are taut. Then the user forces the rod upwardly and allows the rod to rotate in his hands against the leather surface of the gloves while gripping the rod relatively hard so that considerable force is required to unroll the straps from the rolls 26 and 28 thus allowing the rod to move upward. The amount of effort required to carry out the exercise is regulated by the strength with which the user grips the rod. Thus the principle of the device is based on grip slippage.

Veillette, U.S. Pat. No. 4,438,920 discloses a hand held exercise device which includes sleeves 5 formed of a resilient material such as leather, plastic or rubber such that the sleeves can be "squeezed against the body 1 to prevent rotation". The sleeves 5 are retained on the body 1 by plastic cap ends 7 and by a central plastic sleeve 8. This device utilizes a rope or cord 11 to carry a conventional circular weight 14. The weight is slid onto an inverted t-shaped holder 16. Each of the sleeves 5 is gripped in one hand. By squeezing one side of the device and rotating, the cord 11 can be caused to coil around the central sleeve 8, lifting the weight 14. The pressure on such one side of the device is relaxed and the other side or sleeve is squeezed and rotated. Thus, by alternatively squeezing, rotating and releasing the two ends of the device the cord can be caused to coil around the sleeve 8 and raise the weight 14. In this manner, the fingers, hands, wrists and arms are exercised.

While many different wrist roller exercise devices have been proposed such devices each have significant drawbacks. The devices which do not include a frame require the user to use arm, shoulder and back muscles to hold the bar in a desired location before and during the wrist rolling exercise causing fatigue to muscle groups which a wrist roller exercise device is not intended to address. Existing devices which provide a supporting frame unduly restrict the XYZ direction in which the wrist roller exercise device can move thereby directing most of the force of the exercise to the hands and fingers and away from the wrists. Only if the wrist roller exercise device is free to move in all three directional planes (XYZ) can a device direct increased focus on exercising the wrists of the user. Thus, there remains a need for such a device.

SUMMARY OF THE INVENTION

The present invention relates to a wrist roller exercise device which has some important differences from existing wrist roller exercise devices. The first important difference is that the wrist roller exercise device of the present invention has a rotatable rod which is mounted for rotation on a spool carrier which hangs from a cable or rope from an elevated fixed position. Preferably, a frame structure provides the support for the supporting cable although an adapted version of the invention could provide such a suspended cable in a door frame. The roller rod preferably has bushings which would allow it to rotate within the spool carrier. This very important difference allows the entire weight of the device to be supported, thus allowing the user to exercise their hands, wrists and fingers as opposed to placing undue weight on the arms, back and shoulders. Because the spool carrier is suspended from a single point, the rod is moveable essentially any direction in a XYZ with only the center of the spool carrier being supported. A second feature of the present invention which can work in combination with the cable suspended device is the provision of rubber or rubberized handle grips which are designed to slip on the roller rod thus only allowing the roller rod to be rotated when sufficient grip force is placed through the handle grips onto the roller rod. By the proper choice of diameter and materials, the amount of gripping force needed to actually rotate the rod can be varied. A third feature of the present invention is the provision of a double hook bar for holding a dumbbell at a lower end of a rope which is wound up by the roller rod. As used in this patent application and in the claims hereof, the word "rope" is hereby defined broadly and includes any flexible elongated object which can attached to a weight object and can be rolled up on a spool including a rope, a cable or a strap.

In its simplest form, the wrist roller exercise device of the present invention comprises: a) a roller rod having opposite handle end portions and having a central portion; b) a spool carrier having a central balanced cable connection point; c) a cable connected to said cable connection point and connected to an elevated frame member to secure and hold said carrier at a desired elevation above ground surface; d) a spool attached on said central portion of said rod member, said rod member and said spool rotatable relative to said spool carrier, said spool having a rope connection means; and e) a rope having a first rope end attached to said rope connection means and a second rope end connected to a weight object of desired mass.

Preferably said spool carrier has opposite spaced apart parallel carrier ends, each carrier end having a rod hole therein to receive said rod with said central portion of said rod being positioned between said carrier ends, said spool carrier also having a top connected to said carrier ends, said top having said central balanced cable connection point thereon.

Rotating said rod causes said rope to wind up onto said spool thereby lifting the weight object relative to the rod. Because said cable supports the weight of the device so that a user can focus attention on forearm, wrist, hand and finger muscles required to wind up said rope and to keep the device balanced on the cable and not on upper arm, shoulder, chest and back muscles which would otherwise be required to hold and suspend the device in said desired elevation above ground surface if not for said cable.

In one embodiment of the invention, said elevated frame is a horizontal bar member supported in a doorway to which said cable is attached. Preferably, however, said elevated frame has a base, a vertical support member and a horizontal extension member to which said cable is attached.

Preferably, a double hook holder member attached to said second rope end to hold a dumbbell weight member.

Preferably, said handle end portions of said roller rod can freely move in any XYZ direction.

Preferably, oversized rubberized handle grips are provided which slip on the handle end portions whereby the roller rod will rotate only when sufficient grip force is placed through the handle grips onto the roller rod.

In one embodiment, said weight object is a dumbbell and the devise further comprises a double hook bar for balancing and holding said dumbbell at said second end of said rope.

In another embodiment, said weight object is a weight plate secured to said second end of said rope. The weight object can, however, be any object which is tied or secured to the second end of said rope.

DETAILED DESCRIPTION OF THE PREFERRED EMBODIMENTS

The present invention provides a wrist roller exercise device which includes a roller rod 300 which has opposite handle end portions 304 and 308 and having a central portion. The central portion is that portion located beneath the spool 330.

Figure 1:
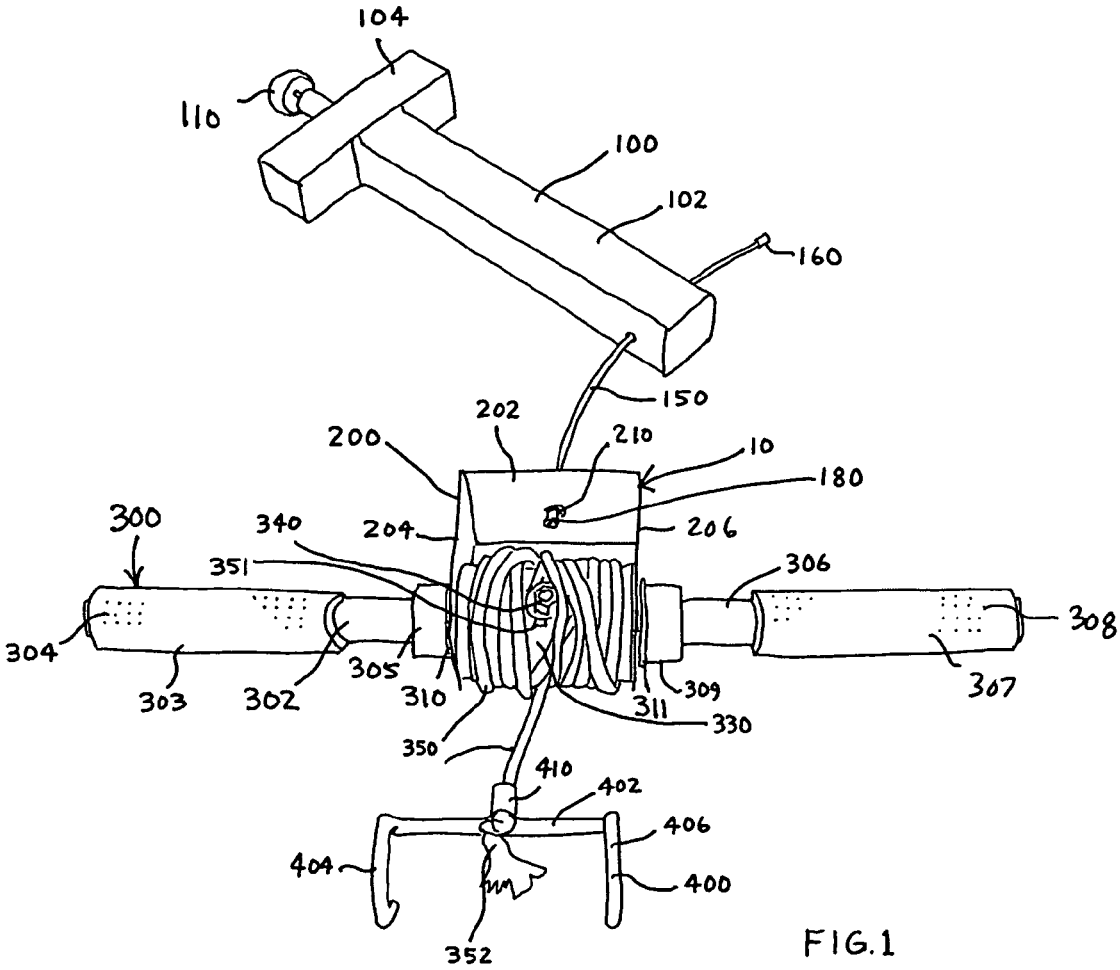
FIG. 1 is a perspective view of the wrist roller exercise device of the present invention showing the primary components thereof in an unmounted position.
Figure 6:
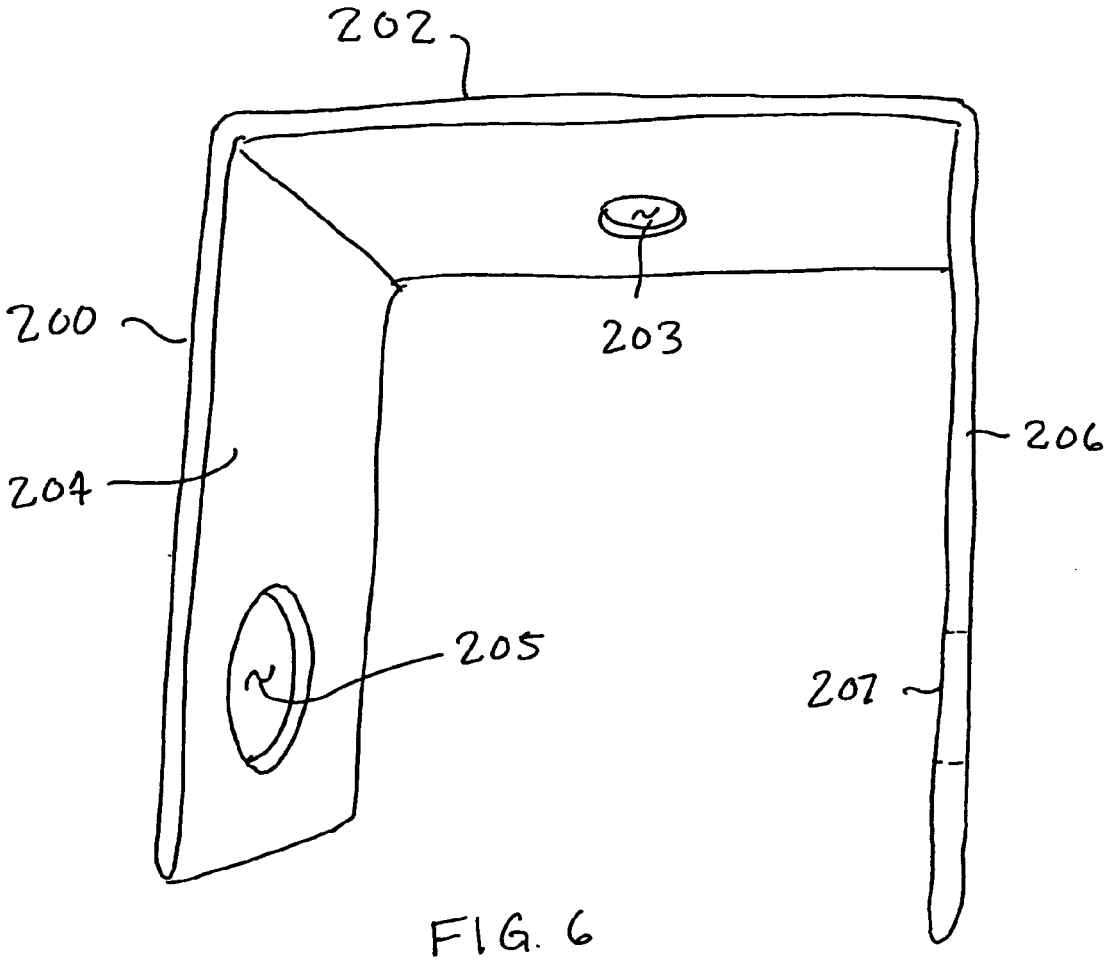
FIG. 6 is a perspective view of the spool carrier.

A spool carrier 200 is provided and preferably has a generally u-shaped configuration as shown in FIG. 6. The spool carrier 200 has a pair of opposite spaced apart parallel carrier ends 204 and 206 and has a top portion 202 which has a hole 203 therein. The hole 203 acts as a central balanced cable connection point. In carrier end 204, a rod hole 205 is provided and in carrier end 206 a rod hole 207 is provided. It will be obvious that the roller rod 300 is inserted through rod holes 205 and 207. As shown in FIG. 1, the spool carrier 200 is held in place by means of a collar 305 screw mounted onto portion 302 of the roller rod 300 and a collar 309 is mounted on portion 306 of the roller rod 300. A set screw 315 (FIG. 8) is utilized to hold the collars 305 and 309 firmly onto the roller rod 300. A first washer like bushing 310 is provided adjacent collar 305 and a second washer like bushing 311 is provided adjacent collar 309. The bushings 310 and 311 can spin freely on the roller rod 300. With this arrangement, the roller rod 300 is able to rotate freely within the spool carrier 200.

A cable 150 is connected to said cable connection point 203, 210 by means of a crimped cable end cap 180. The cable extends through an elevated frame member 100 and the opposite end of the cable 150 is secured by a crimped cable cap member 160. The elevated frame member 100 shown in FIG. 1 has a horizontally extending portion 102 through which the cable 150 extends and has a vertical sleeve portion 104 which is adapted to slide up and down on a vertical frame member (see FIG. 7). A quick release knob 110 allows for easy height adjustment. A spool 330 is attached to the central portion of the roller rod 300 by means of a bolt 341 and nut 340. This secures the spool 330 firmly on to the roller rod 300. The bolt 341 passes through the roller rod 300 so that the spool 330 rotates together with the roller rod 300 as they are in essence one member. It is to be understood that the spool as used in the present invention need not be a separate member but rather may merely be the central portion of the roller rod 300. It is preferable, however, to provide a spool portion that has a larger diameter than the roller rod so that each twist of the wrist creates a larger elevation rise of the weight being lifted.

Figure 2:
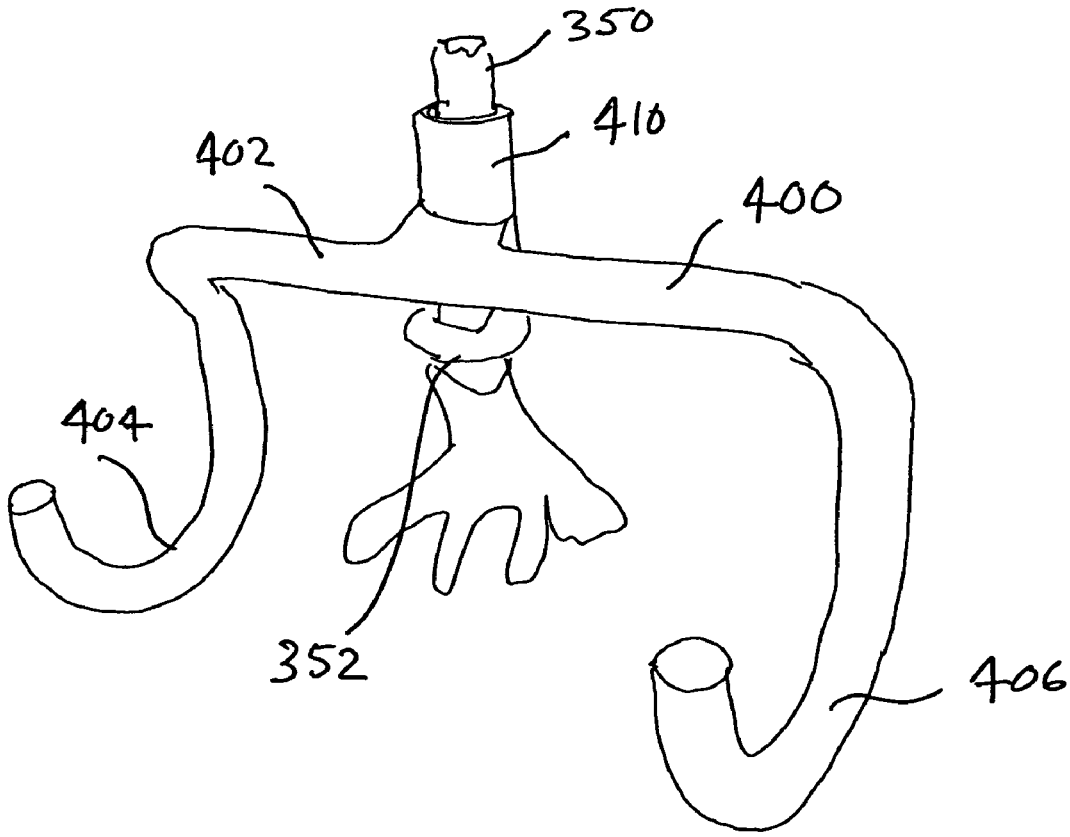
FIG. 2 shows a dumbbell holding bracket for use with the present invention.
Figure 9:
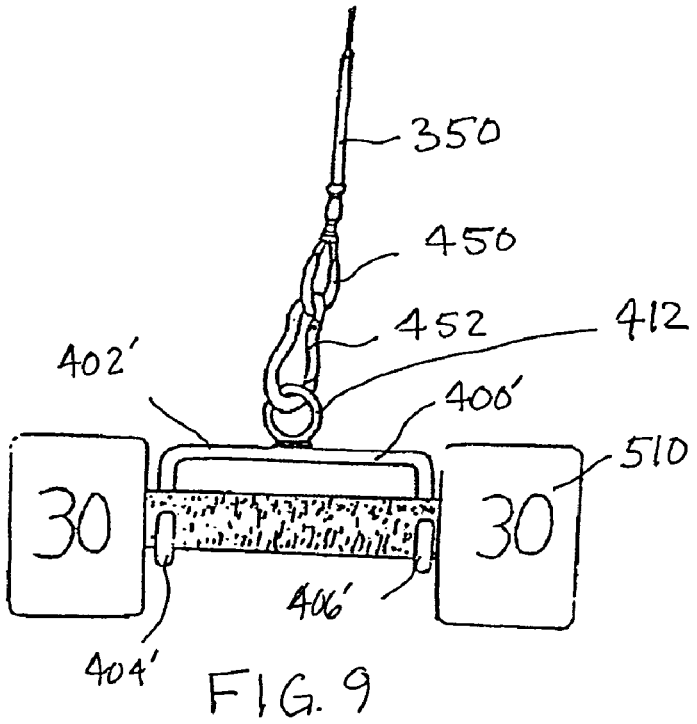
FIG. 9 is a perspective view of the dumbbell holder with a dumbbell attached.

The bolt 341 is also used to connect a first end 351 of a rope member 350 onto the spool 330. An opposite end 352 of the rope 350 is utilized to connect a weight plate 500 to the rope. As shown in FIGS. 1 and 2, a double hook member 400 is provided to hold a dumbbell 510 (FIG. 9). End 352 of rope 350 extends through a balanced opening 410 provided on a horizontal hook member portion 402. Hooks 404 and 406 are used to hold the dumbbell onto the double hook member 400. The end 352 can simply be tied in a knot to secure the double hook member 400 onto the rope 350.

Figure 3:
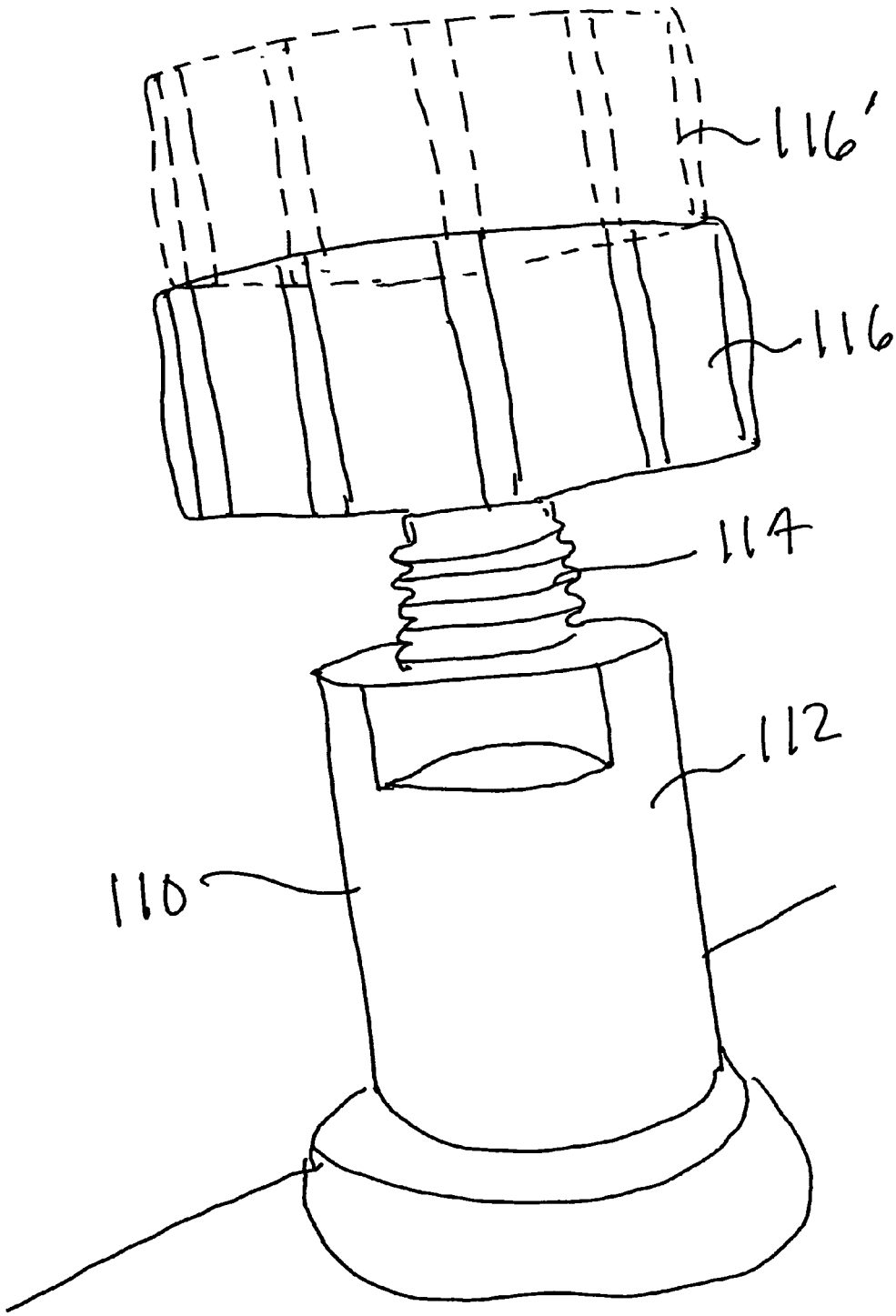
FIG. 3 is a perspective view of a height adjusting pin.

Referring briefly to FIG. 3 the quick release knob 110 is being shown which has a base portion 112, a hand threaded extension 114 and a screw on handle portion 116. The handle may be unscrewed and then pulled outwardly to position 116' to release the quick release knob 110 and allow the frame member 100 to slide vertically upwardly and downwardly on the vertical member 18 shown in FIG. 7.

Figure 4:
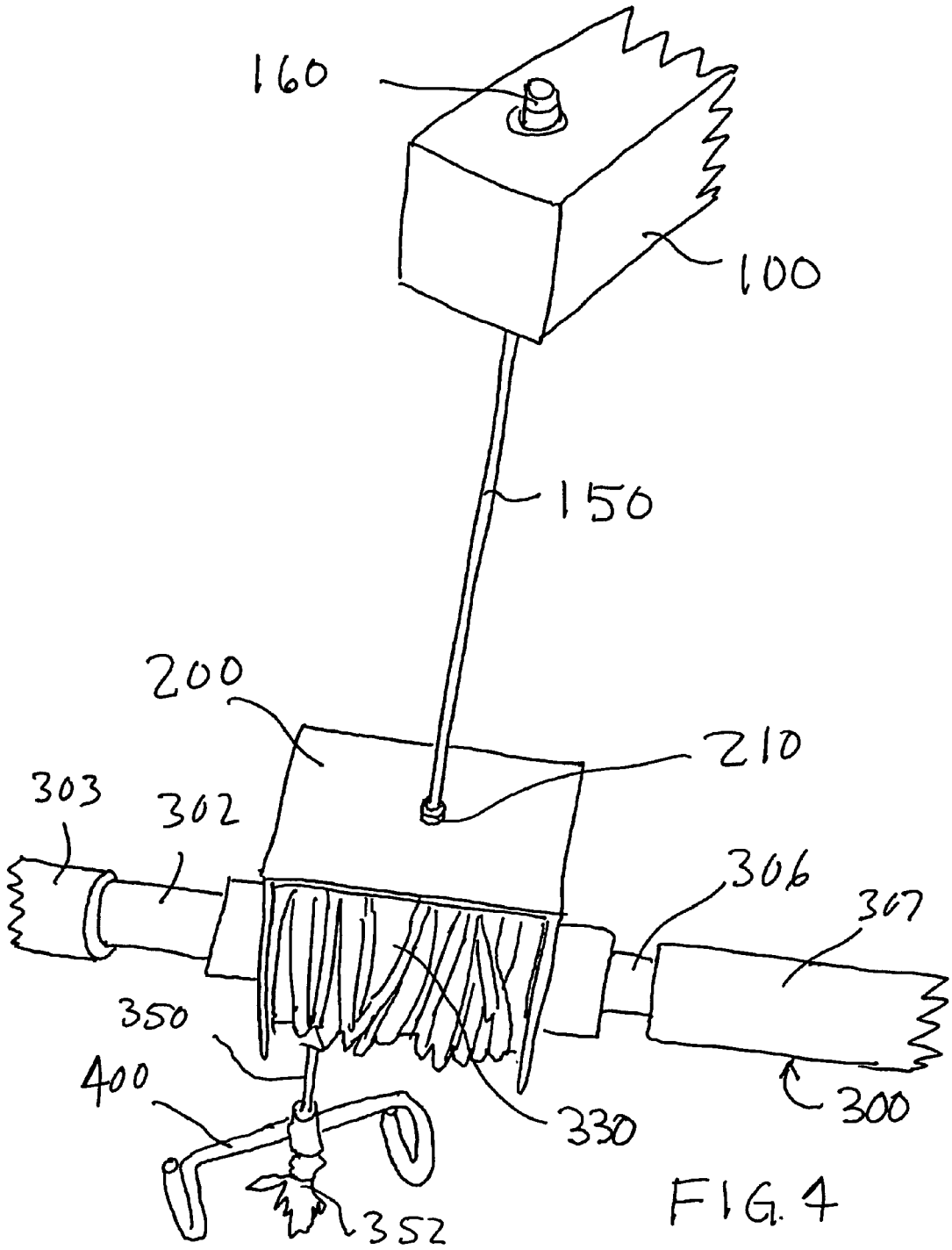
FIG. 4 is a perspective view of the exercise device as suspended from a frame.

FIG. 4 is another view of the wrist roller of the present invention with the device suspended on cable 150. It can be seen that the cable 150 suspends the weight of the device from the central balance cable connection point 210.

Figure 5:
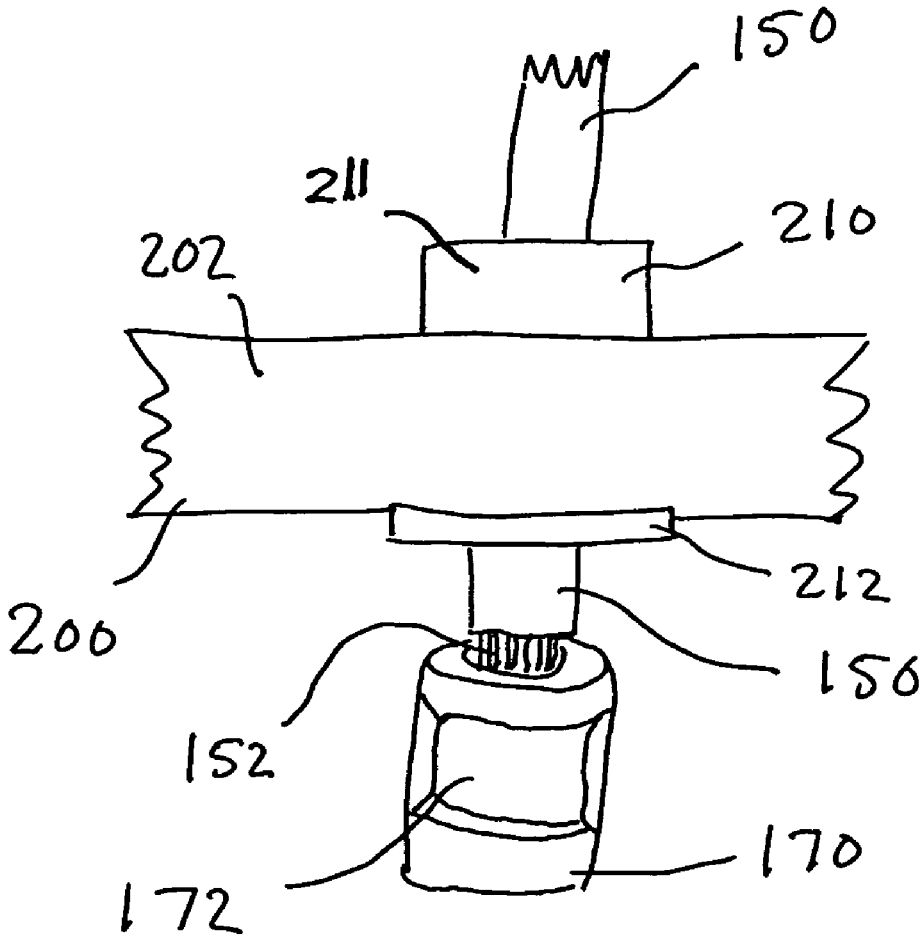
FIG. 5 is a perspective view of the cable attachment to the spool carrier.

Referring to FIG. 5, the central balanced connection point 210 may include a hollow sleeve portion 211 with a flange 212 to hold it in place in the hole 203 of the top 202 of the spool carrier 200. The cable connection cap 170 is crimped inwardly at location 172 to hold to hold it firmly onto the stranded wires 152 located on the interior of the cable 150.

Figure 7:
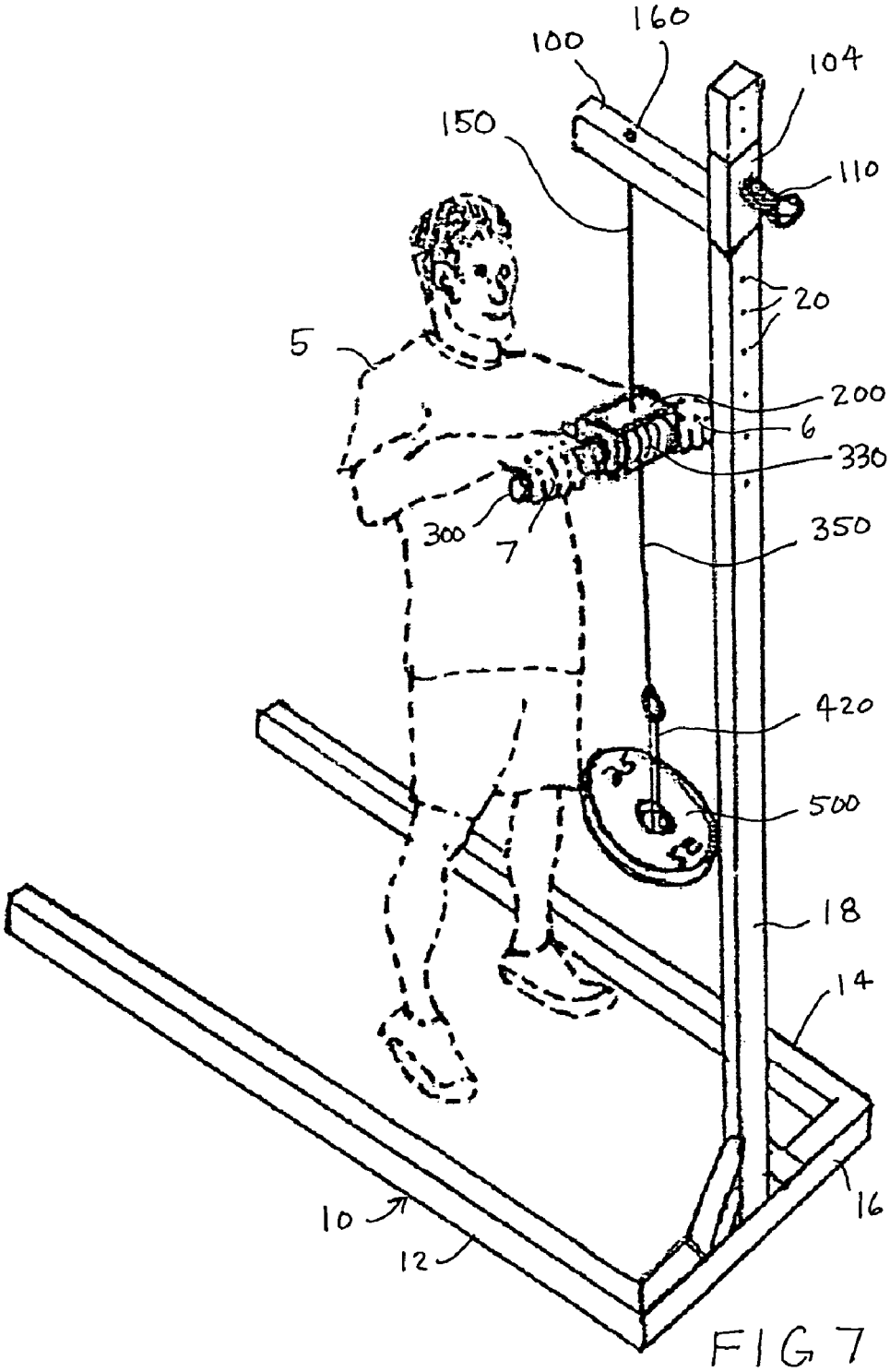
FIG. 7 is a perspective view of the wrist roller exercise device of the present invention in use.

Referring specifically to FIG. 7, the preferred embodiment of the invention is shown. In this embodiment, the elevated frame member 100 is held in place onto a frame 10 which includes a base 12, 14 and 16 and a vertical support member 18 and a horizontal extension member 100 to which the cable 150 is attached. As shown the quick release knob 110 can be unscrewed and then pulled outwardly to allow the horizontal extension member 100 to slide upwardly and downwardly with the quick release knob 110 being able to be inserted into any desire hole 20 so that the device can be placed at any desired elevation above the floor level on which the user 5 is standing. In this embodiment, the user 5 grasps the roller bar 300 with the user's hands 6 and 7 to rotate the weight plate 500 which is attached at 420 to the rope 350 by twisting one hand and then the other.

As shown in FIG. 1, the roller rod 300 has a pair of oversized rubberized handle grips 303 and 307 provided on ends 304 and 308, respectively, of the roller rod 300. These grips, 303 and 307, are designed to slip on the handle portions and will rotate the roller rod 300 only when a sufficient grip force is placed through the handle grips onto the roller rod 300.

Figure 8:
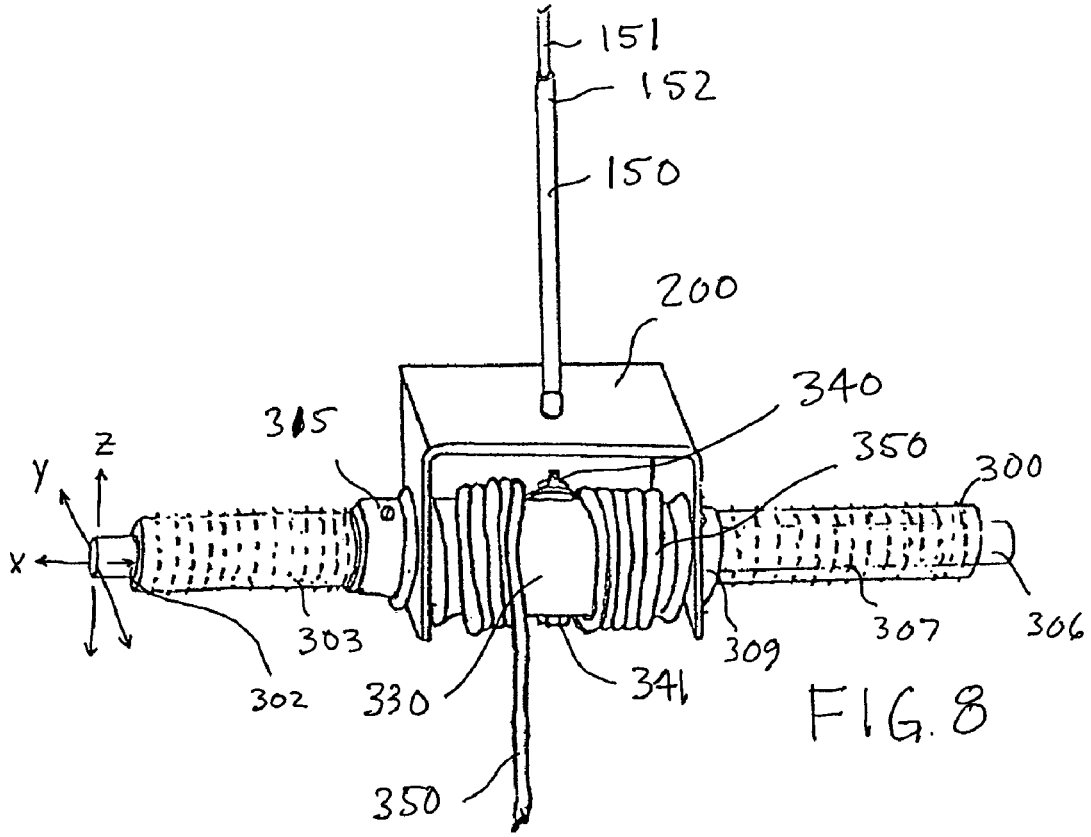
FIG. 8 is a perspective view of the wrist roller exercise device of the present invention showing the directions of movement which the end of the handles may make.

Referring to FIG. 8, it is shown that the ends 302 and 306 of the roller rod 300 may freely move in an XYZ direction. To be more specific when the user is holding the roller rod 300 in his hands, the rod end 302 moves in an X direction when a user slides the bar to the left or to the right. The rod end 302 moves in a Y direction when the user pulls the bar closer or further away from his body. The rod end 302 moves in a Z direction when the handle end 302 is moved upwardly or downwardly. Shown in FIG. 8 the rope 350 is coiled around the spool 330 which is held onto the roller bar by the bolt 341 and nut 340. As mentioned, the nut 340 holds the end 351 of the rope 350 onto the spool 330.

Referring to FIG. 9, an alternative form of a double hook member 400' is shown. This member includes hook portions 404' and 406' and holds a dumbbell 510 in place. A horizontal member 402' connects the hook members 404' and 406'. A generally circular connection loop 412 is provided in this embodiment rather than the sleeve through which the rope 350 can slide. With this embodiment a series of snap-on connectors 450 and 452 can be used to quickly attach or remove the double hook member 400' to the lower end 351 of the rope 350.

Figure 10:
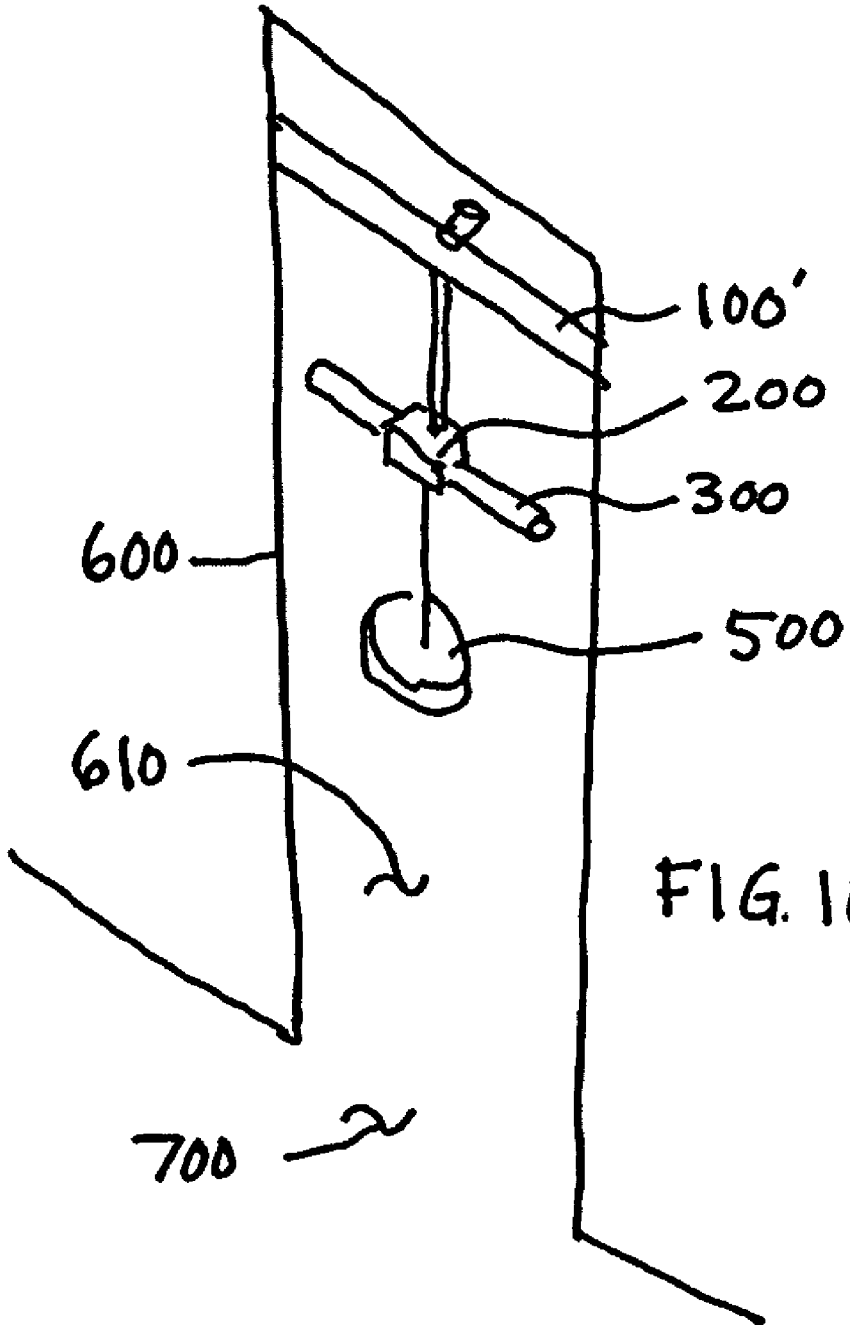
FIG. 10 is a perspective view of a wrist roller exercise device mounted in a door frame.

An alternative form of the invention is shown in FIG. 10 wherein an alternative horizontal bar member 100' is shown mounted in a door frame 600. With this embodiment, the spool carrier 200, roller rod 300 and the weight plate 500 are suspended in the open space 610 of the door way. The user can unroll the device until the weight plate 500 reaches the floor surface 700. Thereafter, the user can roll the device upwardly again to the location of the roller rod 300 and repeat the exercise as often as desired.

I claim:

1. A wrist roller exercise device comprising:

a) a roller rod having opposite handle end portions and having a central portion;

b) a spool carrier having a central balanced cable connection point;

c) a cable having first cable end and a second cable end, said first cable end being connected to said cable connection point and said cable second end being connectable to an elevated frame member to secure and hold said carrier at a desired elevation above a ground surface;

d) a spool attached on said central portion of said rod member, said rod member and said spool rotatable relative to said spool carrier, said spool having a rope connection means;

e) a rope having a first rope end attached to said rope connection means and a second rope end connected to a weight object of desired mass.

2. A wrist roller exercise device according to claim 1 wherein said spool carrier has opposite spaced apart parallel carrier ends, each carrier end having a rod hole therein to receive said rod with said central portion of said rod being positioned between said carrier ends, said spool carrier also having a top connected to said carrier ends, said top having said central balanced cable connection point thereon.

3. A wrist roller exercise device according to claim 1 whereby rotating said rod causes said rope to wind up onto said spool thereby lifting the weight object relative to the rod.

4. A wrist roller exercise device according to claim 1 whereby said cable supports the weight of the device so that a user can focus attention on forearm, wrist, hand and finger muscles required to wind up said rope and to keep the device balanced on the cable and not on upper arm, shoulder, chest and back muscles which would otherwise be required to hold and suspend the device in said desired elevation above ground surface if not for said cable.

5. A wrist roller exercise device according to claim 1 wherein said elevated frame is a horizontal bar member supported in a doorway to which said cable is attached.

6. A wrist roller exercise device according to claim 1 wherein said elevated frame has a base, a vertical support member and a horizontal extension member to which said cable is attached.

7. A wrist roller exercise device according to claim 1 further comprising a double hook holder member attached to said second rope end to hold a dumbbell weight member.

8. A wrist roller exercise device according to claim 1 wherein said handle end portions of said roller rod can freely move in any XYZ direction.

9. A wrist roller exercise device according to claim 1 further comprising oversized rubberized handle grips which slip on the handle end portions whereby the roller rod will rotate only when sufficient grip force is placed through the handle grips onto the roller rod.

10. A wrist roller exercise device according to claim 1 wherein said weight object is a dumbbell and further comprising a double hook bar for balancing and holding said dumbbell at said second end of said rope.

11. A wrist roller exercise device according to claim 1 wherein said weight object is a weight plate secured to said second end of said rope.

* * * * *